US008071904B2

(12) United States Patent
Takikawa et al.

(10) Patent No.: US 8,071,904 B2
(45) Date of Patent: Dec. 6, 2011

(54) ELECTROSTATIC SEPARATION METHOD AND ELECTROSTATIC SEPARATION DEVICE

(75) Inventors: Noboru Takikawa, Machida (JP); Keiichi Mashio, Funabashi (JP); Manabu Masamoto, Kobe (JP); Kouji Fukumoto, Kobe (JP); Yasuhiro Mayumi, Himeji (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 647 days.

(21) Appl. No.: 11/991,903

(22) PCT Filed: Oct. 26, 2006

(86) PCT No.: PCT/JP2006/321323

§ 371 (c)(1), (2), (4) Date: May 21, 2008

(87) PCT Pub. No.: WO2007/049667

PCT Pub. Date: May 3, 2007

(65) Prior Publication Data

US 2009/0065402 A1 Mar. 12, 2009

(30) Foreign Application Priority Data

Oct. 27, 2005 (JP) ..... 2005-312801

(51) Int. Cl.
*B03C 7/00* (2006.01)

(52) U.S. Cl. ..... 209/128; 209/127.1

(58) Field of Classification Search ..... 209/127.1, 209/128–131

See application file for complete search history.

(56) References Cited

U.S. PATENT DOCUMENTS 2,689,648 A * 9/1954 Maestas ..... 209/131
2,847,124 A * 8/1958 Brastad ..... 209/127.1
(Continued)

FOREIGN PATENT DOCUMENTS

EP 1 380 346 A1 1/2004
(Continued)

OTHER PUBLICATIONS

ISA Japan, International Search Report of PCT/JP2006/321323, Nov. 28, 2006, WIPO.
ISA European Patent Office, Search Report of EP 06 82 2299, Mar. 28, 2011, Netherlands, 7 pages.

*Primary Examiner* — Joseph C Rodriguez
(74) *Attorney, Agent, or Firm* — Alleman Hall McCoy Russell & Tuttle LLP

(57) ABSTRACT

The present invention provides an electrostatic separation method and an electrostatic separation device each of which, even in a case where the concentration of unburned components of coal ash produced by a boiler of a coal-fired power plant is as high as 15% to 30%, can stably separate the ash (into high unburned component ash and low unburned component ash) without generating spark, reuse the high unburned component ash as fuel, and reuse the low unburned component ash as, for example, an auxiliary material of concrete.

The electrostatic separation method and the electrostatic separation device each of which separates unburned carbon ash contained in the coal ash by an electrostatic force, wherein: a substantially flat plate lower side electrode and an upper side electrode disposed above the lower side electrode and including a high dielectric resin element are disposed; a separation zone formed by an electrostatic force is formed by generating a DC electric field between the lower side electrode and the upper side electrode where one of the lower side electrode and the upper side electrode is a positive polarity, and another electrode is a negative polarity; and the unburned carbon ash in the coal ash supplied to the separation zone is separated.

5 Claims, 10 Drawing Sheets

U.S. PATENT DOCUMENTS

| | | | | | |
|---|---|---|---|---|---|
| 3,991,312 | A | * | 11/1976 | Whetten et al. | 250/385.1 |
| 4,172,028 | A | * | 10/1979 | Dunn | 209/12.2 |
| 4,247,390 | A | * | 1/1981 | Knoll | 209/129 |
| 4,440,638 | A | * | 4/1984 | Judy et al. | 204/672 |
| 5,829,598 | A | * | 11/1998 | Whitlock | 209/128 |
| 6,461,409 | B1 | * | 10/2002 | Neff et al. | 95/78 |
| 6,498,313 | B1 | * | 12/2002 | Stencel et al. | 209/131 |
| 7,119,298 | B2 | * | 10/2006 | Yoshiyama et al. | 209/127.1 |
| 2004/0035758 | A1 | * | 2/2004 | Yoshiyama et al. | 209/129 |
| 2010/0132562 | A1 | * | 6/2010 | Noh et al. | 96/99 |

FOREIGN PATENT DOCUMENTS

| | | | | |
|---|---|---|---|---|
| GB | 1 369 335 | A | | 10/1974 |
| JP | 60-148044 | | | 10/1985 |
| JP | 04201320 | A | * | 7/1992 |
| JP | 08-179590 | A | | 7/1996 |
| JP | 2004-25128 | | | 1/2004 |
| WO | 02/076620 | | | 10/2002 |
| WO | 2005/069460 | A1 | | 7/2005 |

* cited by examiner

[図16]

ELECTROSTATIC SEPARATION METHOD AND ELECTROSTATIC SEPARATION DEVICE

TECHNICAL FIELD

The present invention relates to an electrostatic separation method and an electrostatic separation device each of which separates unburned carbon ash contained in coal ash by an electrostatic force.

Specifically, the present invention relates to an electrostatic separation method and an electrostatic separation device each of which separates ash contained in coal ash produced by, for example, a boiler of a coal-fired power plant.

BACKGROUND ART

For example, about 20% or more of the coal ash produced by a boiler of a coal-fired power plant, etc. is unburned carbon. Separating and collecting this unburned carbon and using it as energy source have been studied, and various proposals have been presented.

For example, WO 2002/076620 (Patent Document 1) describes an electrostatic separation method, electrostatic separation device and manufacturing system for particles, and proposes an electrostatic separation device which separates a particulate material that is a mixture of electrically-conductive components and insulating components into the electrically-conductive components and the insulating components by the electrostatic force.

FIG. 5 of Patent Document 1 (see FIG. 1 of the present application) shows one example of a conventional electrostatic separation device. This conventional electrostatic separation device is configured such that electrodes are disposed on an upper side and a lower side, a gas diffusion plate electrode (laminated sintering porous electrode) having air permeability is disposed as a lower side electrode 1, and a wind box 6 disposed below the lower side electrode 1 blows air to fluidize powder.

As an upper side electrode 2, a substantially flat plate mesh electrode having a large number of openings through which particles pass is disposed. Further, a vibrator or a knocker 5 is attached to give vibration to the entire device. Patent Document 1 describes a method for applying a DC high voltage between the upper and lower side electrodes, supplying to an electrostatic separation zone 3 the particulate material (concentration of unburned components=electrically-conductive particle weight ratio of 2% to 5%) that is a mixture of electrically-conductive particles (unburned components) and insulating particles (ash components), and carrying out the electrostatic separation while applying vibration to the device.

However, in accordance with the method described in Patent Document 1, there is a problem that in a case where the concentration of the unburned component of the particulate material that is the mixture of the electrically-conductive component and the insulating component is as high as 15% to 30%, the increase of the concentration of the electrically-conductive component in the air in the electrostatic separation zone 3 is unavoidable, and the separation performance deteriorates due to the decrease of the insulation property and the generation of the spark.

Patent Document 1: WO 2002/076620

DISCLOSURE OF THE INVENTION

Problems to be Solved by the Invention

An object of the present invention is to provide an electrostatic separation method and an electrostatic separation device each of which solves the above problems associated with the prior art, can stably separate ash (into high unburned component ash and low unburned component ash) without generating the spark even in a case where the concentration of the unburned component in the coal ash produced by the boiler of the coal-fired power plant is as high as 15% to 30%, can reuse the high unburned component ash as fuel, and can reuse the low unburned component ash as, for example, an auxiliary material of concrete.

Means for Solving the Problems

The present invention was made as a result of diligent studies to solve the above problems, and summaries of the present invention are the following contents recited in CLAIMS.

(1) An electrostatic separation method for separating unburned carbon ash contained in coal ash by an electrostatic force, comprising the steps of:
  1) disposing a lower side electrode and an upper side electrode;
  2) providing a high dielectric resin element in a circuit for applying a voltage between the lower side electrode and the upper side electrode; and
  3) generating a DC electric field between the lower side electrode and the upper side electrode.

(2) The electrostatic separation method according (1), wherein the upper side electrode includes the high dielectric resin element, and the DC electric field is generated between the lower side electrode and the upper side electrode.

(3) The electrostatic separation method according to (1) or (2), wherein the upper side electrode is a mesh electrode including the high dielectric resin element having a rod shape.

(4) The electrostatic separation method according to any one of (1) to (3), wherein the upper side electrode is a flat plate electrode made of high dielectric resin.

(5) The electrostatic separation method according to any one of (1) to (4), further comprising the step of removing powder adhered to the upper side electrode.

(6) An electrostatic separation device which separates unburned carbon ash contained in coal ash by an electrostatic force, comprising:
  1) a lower side electrode and an upper side electrode disposed above the lower side electrode with a predetermined distance therebetween; and
  2) a high dielectric resin element provided in a circuit for applying a voltage between the lower side electrode and the upper side electrode.

(7) The electrostatic separation device according to (6), further comprising:
  1) a DC power source connected to at least one of the lower side electrode and the upper side electrode, wherein:
  2) the upper side electrode includes the high dielectric resin element; and
  3) a voltage is applied between the lower side electrode and the upper side electrode.

(8) The electrostatic separation device according to (6) or (7), wherein the upper side electrode comprises a resin rod electrode made of high dielectric resin and a mesh electrode having a large number of openings which allow the coal ash to pass therethrough.

(9) The electrostatic separation device according to any one of (6) to (8), wherein the upper side electrode is a flat plate electrode made of high dielectric resin.

(10) The electrostatic separation device according to any one of (6) to (9), further comprising a remover for removing powder adhered to the upper side electrode by using air.

(11) The electrostatic separation device according to any one of (6) to (10), further comprising a remover for removing the powder adhered to the upper side electrode using means for vibrating or impacting the upper electrode.

(12) The electrostatic separation device according to any one of (6) to (11), further comprising a device which is configured to sandwich a resin rod or a resin plate by a metal terminal and is inserted into a portion of a feeder line extending between the lower side electrode and the DC power source and/or between the upper side electrode and the DC power source.

Effects of the Invention

The present invention has industrially useful, significant effects, for example, the present invention can provide an electrostatic separation method and an electrostatic separation device each of which can stably separate ash (into the high unburned component ash and the low unburned component ash) without generating the spark even in a case where the concentration of the unburned component in the coal ash produced by the boiler of the coal-fired power plant is as high as 15% to 30%, can reuse the high unburned component ash as fuel, and can reuse the low unburned component ash as, for example, the auxiliary material of concrete.

BEST MODE FOR CARRYING OUT THE INVENTION

Embodiments of the present invention will be explained in detail with reference to FIGS. 2 to 17.

The present inventors have been diligently studying an ash separation technique (technique of separating into high unburned carbon ash and low unburned carbon ash) in a case where the concentration of the unburned carbon contained in the coal ash produced by a coal-fired boiler is as high as 15% to 30%. Hereinafter, explanations will be made on the assumption that the coal ash is used as the material.

Experiment Using Metal Mesh

Figure 1:
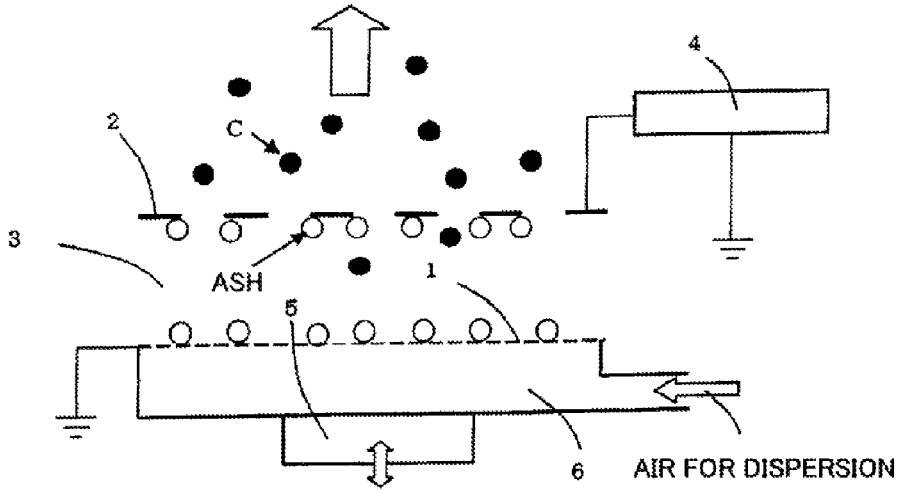
(Prior Art) Fig. 1
FIG. 1 is a diagram showing a conventional electrostatic separation device.

A small device (plane area of 100 mm (width)×200 mm (length), distance between upper and lower electrodes of 80 mm) having the same function as the device described in Patent Document 1 was actually prepared to confirm the problems of the above-described prior art, and a verification experiment was carried out. As shown in FIG. 1, the experiment was carried out such that a metal mesh electrode (mesh size of 15 mm, wire diameter of 1 mm) was prepared as a mesh electrode that is an upper side electrode 2, a DC high voltage power source 4 directly supplied power to the metal mesh electrode, and the coal ash (unburned carbon concentration of 15% to 30%) was used as the material. Results of the experiment are shown below.

Figure 2:
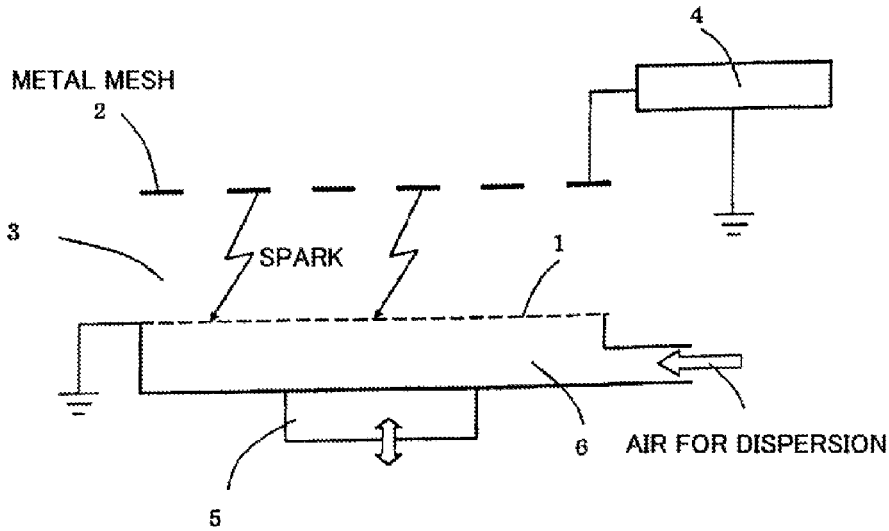
(Prior Art) Fig. 2
FIG. 2 is a diagram for explaining a mechanism of spark generation in the conventional electrostatic separation device.

As a result of the experiment using the metal mesh, as shown in FIG. 2, it is found that the spark is generated from some portions between the upper and lower electrodes when the voltage is 5 KV or more, and the separation performance deteriorates.

Thus, this experiment has verified that the spark is generated by using the coal ash (unburned component concentration of 15% to 30%) in the case of the metal mesh electrode.

Experiment Using Resin Mesh

Next, a mesh electrode (hereinafter referred to as "resin mesh electrode") made of high dielectric resin that is an insulator was prepared as an alternative to the metal mesh electrode for measures against the spark, and an experiment was carried out in the sane manner as above.

A resin mesh electrode (mesh obtained by making several tens of holes each having Φ10 on a flat plate having a thickness of 3 mm) used as the mesh electrode 2 is made of high dielectric resin. Therefore, in a case where power is directly supplied to the resin mesh electrode from a metal terminal that is a feeding point of a DC high voltage power source, dipoles are generated in the resin. On this account, a potential that is equal to the potential of the supplied power can be uniformly applied to the surface of the resin mesh electrode, and the electrostatic separation can be carried out by utilizing this potential. This has already been found by the past various experiments, so that this was used in this experiment.

Figure 3:
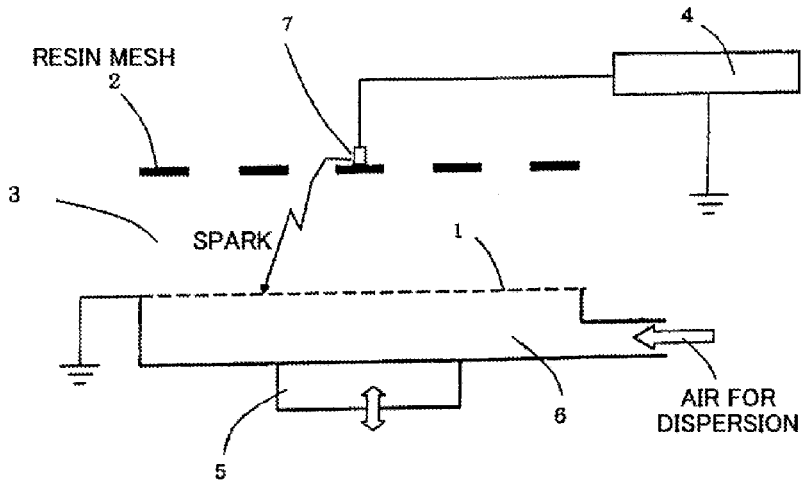
(Prior Art) Fig. 3
FIG. 3 is a diagram for explaining the mechanism of the spark generation in the conventional electrostatic separation device.

As a result of the experiment using the resin mesh, as shown in FIG. 3, it is found that the spark is generated between the metal terminal that is the feeding point and the lower side electrode when the voltage is 20 KV or more, and the separation performance deteriorates.

This experiment has also verified that the spark is generated although the voltage of the spark generation in this case is higher than that in the case of the metal mesh.

Thus, since the spark is generated regardless of the material of the mesh electrode 2 although the voltage level changes, the present inventors have studied the mechanism of the spark generation and the prevention of the spark generation as follows.

Mechanism of Spark Generation

In the mechanism of the spark generation, qualitatively, corona discharge is generated at a portion where an electric field is strong, and an electron avalanche phenomenon occurs while ionizing ambient air. Although subsequent phenomenon is not described in detail, a plasma state thin discharge path (streamer) is eventually formed, an electrical short circuit is generated between the upper and lower electrodes, and electrons are continuously supplied from the power source. Therefore, a large current flows when viewed from the power source side. This phenomenon is visually recognized as the spark.

Next, consideration is made quantitatively. As a result of study of one example of the metal mesh electrode, the following theoretical formula can be theoretically derived: where an electric field Ec (voltage for starting the ionization) for starting the corona discharge of the air is generally 3 KV/mm, the wire diameter of the metal mesh electrode is 1 mm (wire radius r=0.5 mm), V denotes the voltage applied to the metal mesh electrode, and G denotes a space gap between the upper and lower electrodes.

$$V=Ec\cdot r\cdot\ln(G/r) \quad 1)(a)$$

2) To obtain the space gap G where the ionization starts, the following formula is obtained by changing Formula (a).

$$G=r\cdot\exp(V/Ec/r) \quad 3)(b)$$

4) It is found that in a case where r of 0.5 mm, Ec of 3 KV/mm, and the applied voltage V of 5, 6, 7 or 8 KV are assigned in Formula (b), the ionization start space gap G becomes 14, 27, 53, or 103 mm.

To be specific, if the concentration of the unburned carbon in the coal ash increases, the insulating property of the electrostatic separation zone deteriorates. Therefore, even if the space gap G between the upper and lower electrodes is 80 mm, the space gap G of 80 mm is equivalent to the shorter space gap G. Maybe because of this, in the case of the metal mesh electrode, the spark was generated even though the voltage was about 6 to 7 KV. Moreover, the spark generation voltage of the metal terminal that is the feeding point of the resin mesh electrode is somewhat high, that is, 20 KV or more. This is maybe because since part of a spark generation path bypasses the resin mesh electrode, this bypassing is equivalent to the increase of the space gap.

Prevention of Spark Generation

In the case of focusing only on the metal mesh electrode, the wire diameter may be increased to prevent the spark generation. For example, by setting the wire diameter to be 2 mm (wire radius r=1 mm) in the above conditions, the ionization start space gap G can be advantageously made to be 14 mm when the applied voltage V is 8 KV. However, the weight of the metal mesh electrode becomes heavy, and firm attachment is needed. In addition, there are no such commercial products, so that there may be a possibility that custom-made products need to be made. This is high in cost and is not economical.

Figure 4:
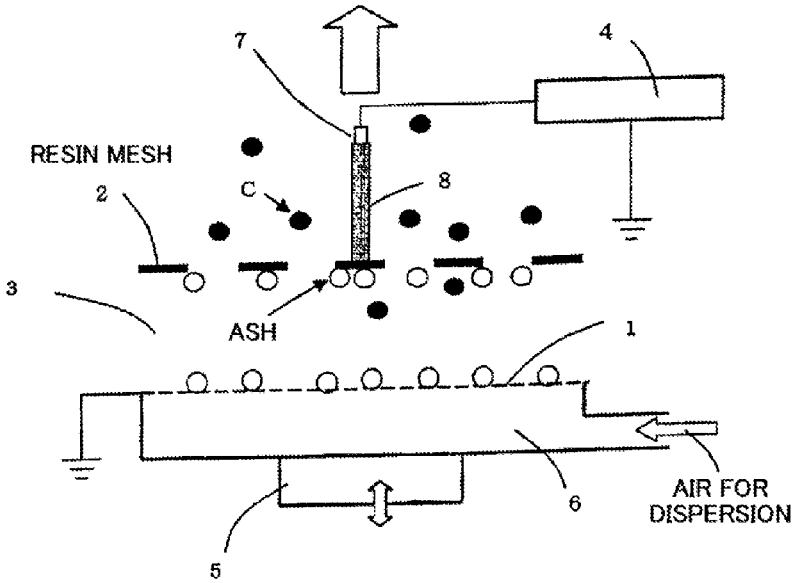
FIG. 4 is a diagram showing an embodiment which uses a resin rod electrode in an electrostatic separation device of the present invention.

Therefore, for the purpose of prevention of the spark generation herein, preventing the occurrence of the electron avalanche phenomenon to the generation of the streamer was studied. As specific countermeasures, the problem was considered to be direct power supply from the metal terminal that is the feeding point of the DC high voltage power source to the metal mesh electrode (or the resin mesh electrode). As Countermeasure 1, based on the idea that rapid supply of the electrons from the power source needs to be prevented, but the potential needs to be transmitted, conceived was the idea that the resin rod electrode 8 (which corresponds to a high dielectric resin element of the present invention and is hereinafter referred to as "resin rod electrode 8") made of the high dielectric resin is inserted between the mesh electrode 2 (that is the metal mesh electrode or the resin mesh electrode) and the metal terminal 7 that is the feeding point of the DC high voltage power source 4, as shown in FIG. 4.

Therefore, even in a case where the concentration of the unburned component (C) in the electrostatic separation zone 3 is as high as 15% to 30%, it is possible to prevent the spark generation without deteriorating the ash separation performance by preventing the rapid supply of the electrons from the power source.

Figure 5:
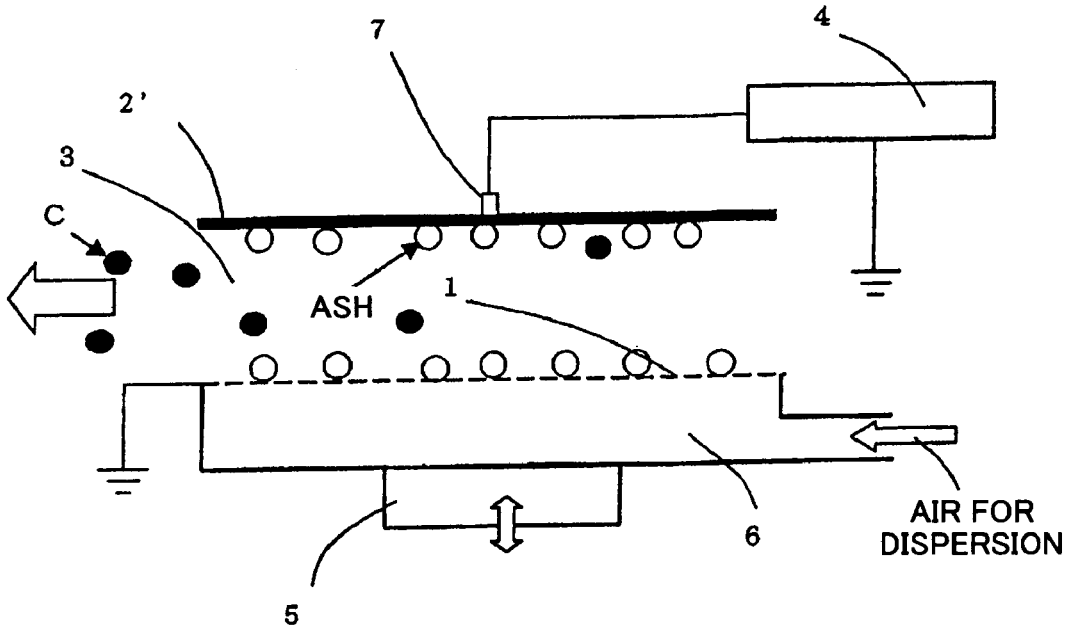
FIG. 5 is a diagram showing an embodiment which use a flat plate electrode made of high dielectric resin in the electrostatic separation device of the present invention.

Moreover, as Countermeasure 2, conceived was the idea that a flat plate electrode (which corresponds to the high dielectric resin element of the present invention and is hereinafter referred to as "resin plate electrode") 2' not having the mesh shown in FIG. 5 and made of the high dielectric resin is used as an alternative to the mesh electrode 2. As a result of the actual experiment, it is found that even in a case where the concentration of the unburned component (C) in the electrostatic separation zone 3 is as high as 15% to 30%, the spark generation is prevented without deteriorating the ash separation performance by preventing the rapid supply of the electrons from the power source.

Since the following explanation is common to the resin mesh electrode, the metal mesh electrode and the resin plate electrode, these electrodes are collectively called "upper side electrode".

As the material of the high dielectric resin element of the present invention, any high dielectric resin, such as phenol resin or vinyl chloride resin, can be used.

Current Generation

Although the spark generation can be prevented, a phenomenon that the current slightly flows occurs when a continuous running time of about ten minutes has passed. When the current increases gradually up to about 1 mA, a current limiting function (function of decreasing the voltage while maintaining the current to be the set current of 1 mA) of the DC high voltage power source works, the applied voltage decreases, so that the separation performance deteriorates. Therefore, the mechanism of the current generation and the prevention of the current generation are studied next.

Experiment for Estimation of Mechanism of Current Generation

The following five items were estimated as causes of the current generation, and were verified using an experimental apparatus including a combination of the resin rod electrode and the resin mesh electrode. Thus, the causes of the current generation were investigated.

Estimation 1

The current of about 1 mA is actually flowing through the resin rod electrode.

Result of Experiment for Verifying Estimation 1

Since it is understood that the actual current value of the resin having the polymer structure was $10^{-11}$ (A/cm$^2$), and the current hardly flows, it is found that Estimation 1 is not the cause of the current generation.

Estimation 2

Positive and negative ions are generated by the ionization at the metal terminal that is the feeding point of power feeding from the DC high voltage power source to the resin rod electrode, and the ions are accumulated on the resin rod electrode and wall surfaces, thereby causing the current to flow.

Result of Experiment for Verifying Estimation 2

If the cause of the current generation is the ion accumulation, the current is expected to decrease immediately after the switching of the power source, since ion neutralization occurs by switching the polarity of the power source. However, the current decrease was not confirmed according to the experiment result. Therefore, it is found that Estimation 2 is not the cause of the current generation.

Estimation 3

The conductivity of the air containing fine powdered carbon increases, and thereby the current flows.

Result of Experiment for Verifying Estimation 3

After the load operation was carried out for sixty minutes, the current value has reached 0.1 mA. After that, the load operation was stopped. The current flow was investigated in this state. As a result of the experiment, the current of 0.1 mA has flown even after the load operation was stopped. Therefore, it is found that Estimation 3 is not the cause of the current generation.

Estimation 4

The current flows due to the current path formed by the powder adhered to the surface of the resin rod electrode.

Result of Experiment for Verifying Estimation 4

After the load operation was carried out for sixty minutes, the current value has reached 0.1 mA. After that, the load operation was stopped. The powder adhered to the surface of the resin rod electrode was removed in this state. As a result of the experiment, the current of 0.1 mA has flown even though the powder was removed. Therefore, it is found that Estimation 4 is not the cause of the current generation.

Estimation 5

The ionization occurs since the electric field becomes partially strong due to the adherence (adherence of micro projections) of the powder to the lower surface of the upper side electrode. Positive and negative ions generated by this ionization move to the power source side and the ground side, thus causing the current to flow.

Result of Experiment for Verifying Estimation 4

The powder adhered to the lower surface of the upper side electrode was removed by directly blowing air during the load operation. As a result of the experiment, it is confirmed that the current does not flow. Thus, it is found that the cause of the current generation is the adherence of the powder to the lower surface of the upper side electrode.

Additional Experiment for Specifying Portion where Current is Generated

Moreover, although it is found that the cause of the current generation is the adherence of the powder to the lower surface of the upper side electrode, an experiment was carried out to confirm whether the powder needs to be removed from the entire lower surface or part of the lower surface to prevent the current generation. As a result, it is found that the current does not flow by partially removing the powder adhered in the vicinity of the lower portion of the resin rod electrode.

Estimation of Mechanism of Current Generation

Figure 6:
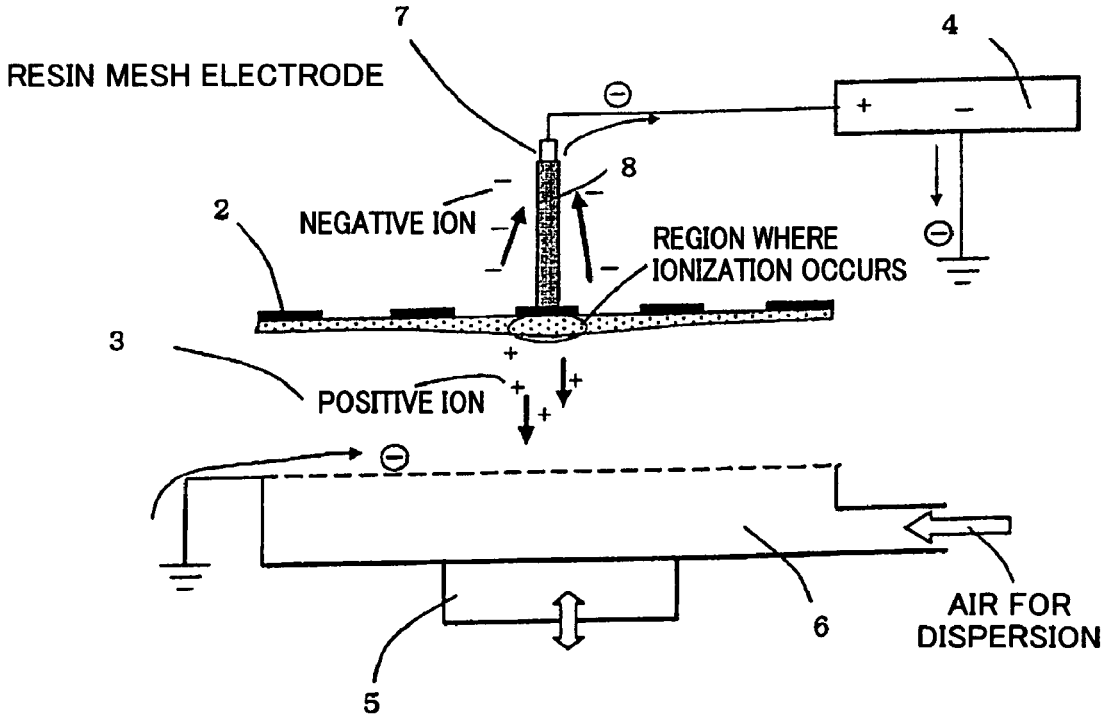
FIG. 6 is a diagram for explaining a mechanism of preventing current generation in the electrostatic separation device of the present invention.

As a result of estimation of the mechanism of the current generation based on the results of the above various experiments, as shown in FIG. 6, by carrying out the load operation while applying the voltage, the powder adheres to the lower surface of the upper side electrode 2 by the electrostatic force. The electric field in the vicinity of the lower portion of the resin rod electrode 8 is stronger than that of the other portions of the upper side electrode. If the powder adheres, the powder becomes micro projections, the electric field on the surface of the projection is strong, the corona discharge starts gradually, positive and negative ions are generated by ionizing air, and the powder charged by the ions further adheres to and accumulates on the projections. As the thickness of this powder layer increases, the electric charge maintained in the powder increases, and the intensity of the electric field in the powder layer increases, so that positive and negative ions are generated increasingly. It is estimated that the positive and negative ions are attracted to the power source side and the ground side, the electron exchange is carried out on both sides, and the current flows when viewed from the power source side.

Countermeasure Against Spark and Current Generation

In summary, the rapid supply of the electrons from the power source is prevented by disposing the resin rod electrode 8 on the upper portion of the mesh electrode 2, such as the metal mesh electrode or the resin mesh electrode, or by using the resin plate electrode 2' as an alternative to the mesh electrode, and thus the spark can be suppressed.

The diameter of the resin rod electrode 8 is desirably Φ5 to Φ150, and preferably Φ20 to Φ40, and the length of the resin rod electrode 8 is desirably 0 mm to 300 mm, and preferably 0 mm to 200 mm. Moreover, the thickness of each of the resin mesh electrode and the resin plate electrode is desirably 1 mm to 20 mm, and preferably 3 mm to 5 mm.

By partially removing the powder adhered to the lower surface of the upper side electrode, the current generation can be suppressed. Even in a case where it is difficult to remove the adhered powder, a resin rod electrode similar to the resin rod electrode 8 is inserted into an intermediate point of the feeder line extending between the power source side and the ground side so that the positive and negative ions generated due to the adherence of the powder cannot exchange the electrons with the power source side or the ground side. This has an effect of suppressing the current generation, which has already been verified by an additional verification experiment, although details of the additional verification experiment are omitted herein (the resin rod electrode inserted into the intermediate point of the feeder line also corresponds to the high dielectric resin element of the present invention and is hereinafter referred to as "intermediately inserted resin rod electrode").

Hereinafter, preferred embodiments of the electrostatic separation device of the present invention will be explained.

Embodiments 1 to 7 shows cases including the resin rod electrode 8, and Embodiments 8 and 9 shows cases not including the resin rod electrode 8.

Embodiment 1

Figure 7:
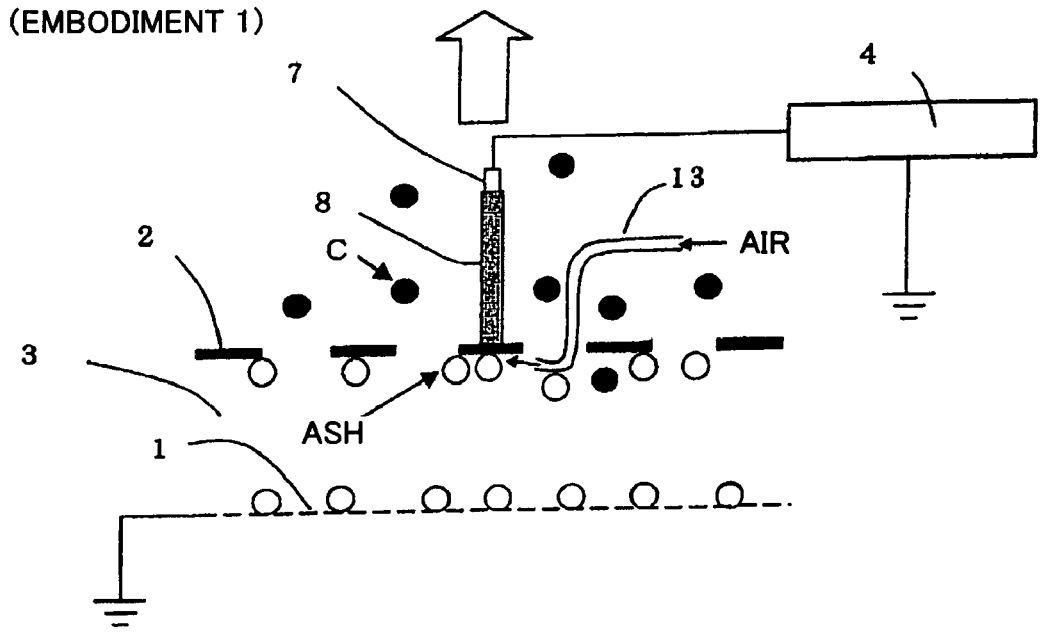
FIG. 7 is a diagram showing Embodiment 1 which uses the resin rod electrode and air supply in the electrostatic separation device of the present invention.

FIG. 7 is a diagram showing Embodiment 1 which uses means for removing the adhered powder by the resin rod electrode and air supply in the electrostatic separation device of the present invention.

An air pipe is extended from above the upper side electrode 2 to the vicinity of the lower portion of the resin rod electrode 8 corresponding to the high dielectric resin element of the present invention, so that the powder is removed directly by the air.

The current flows by the ionization which is caused due to the powder adhered to the vicinity of the lower portion of the resin rod electrode 8. Therefore, the current generation can be prevented by directly blowing the air to remove the adhered powder.

An area where the powder is removed is desirably the entire area, and preferably an area that is twice to four times as large as the diameter of the resin rod electrode.

As the amount of air, the linear velocity of the air is desirably 1 m/s to 20 m/s, and preferably 5 m/s to 15 m/s.

Embodiment 2

Figure 8:
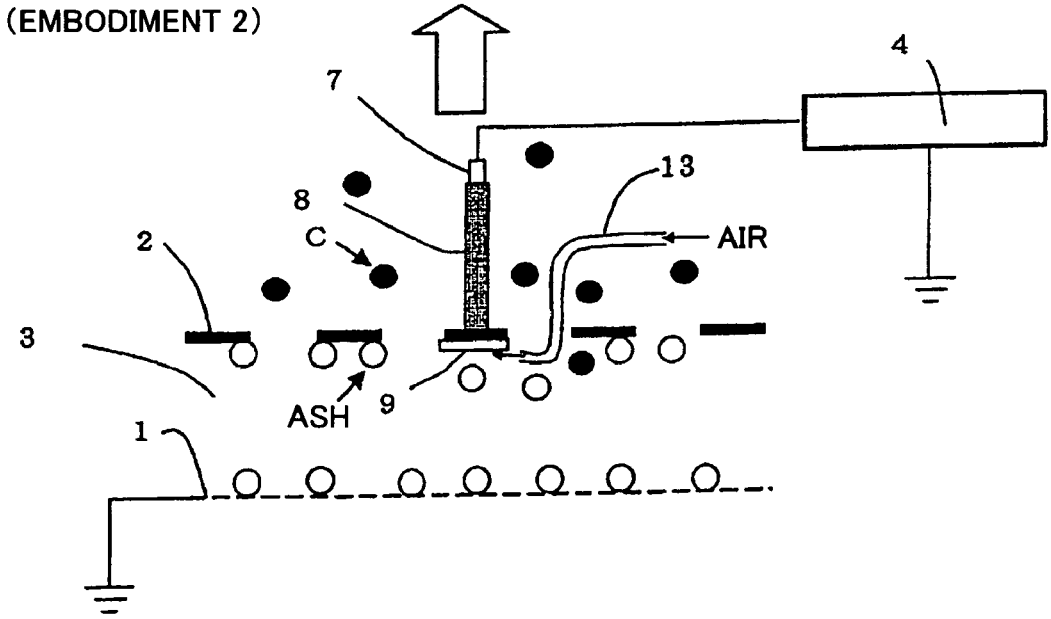
FIG. 8 is a diagram showing Embodiment 2 which uses the resin rod electrode, the air supply and a low dielectric in the electrostatic separation device of the present invention.

FIG. 8 is a diagram showing Embodiment 2 which uses means for removing the adhered powder by the resin rod electrode and the air supply, and a low dielectric in the electrostatic separation device of the present invention.

A plate of a low dielectric 9 is attached to the vicinity of the lower portion of the resin rod electrode 8 corresponding to the high dielectric resin element of the present invention, and the air pipe is extended from above the upper side electrode 2 to the vicinity of the lower portion of the resin rod electrode 8, so that the powder is removed directly by the air.

By attaching the plate of the low dielectric 9 to the vicinity of the lower portion of the resin rod electrode 8, it is possible to reduce the amount of powder adhered. Therefore, it becomes easy to remove the powder by the air blow.

The material of the low dielectric 9 may be any low dielectric material, such as Teflon (registered trademark) resin or silicon resin.

Embodiment 3

Figure 9:
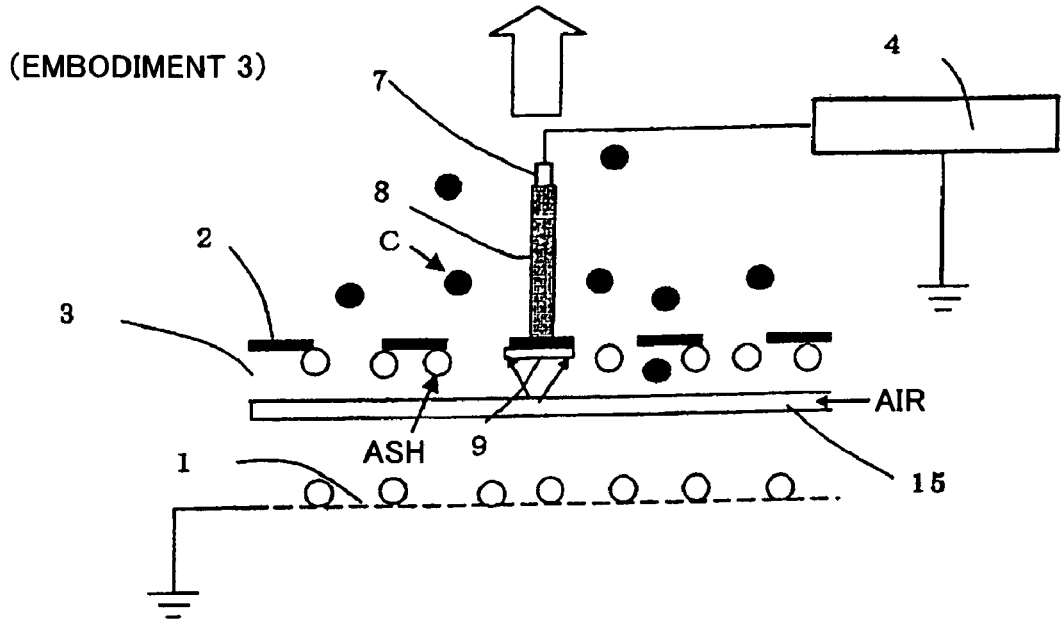
FIG. 9 is a diagram showing Embodiment 3 which uses the resin rod electrode, an air pipe and the low dielectric in the electrostatic separation device of the present invention.

FIG. 9 is a diagram showing Embodiment 3 which uses means for removing the adhered powder by the resin rod electrode and the air pipe, and the low dielectric in the electrostatic separation device of the present invention.

The plate of the low dielectric 9 is attached to the vicinity of the lower portion of the resin rod electrode 8 corresponding to the high dielectric resin element of the present invention, and the air pipe is extended from below the upper side electrode 2 to the vicinity of the lower portion of the resin rod electrode 8, so that the powder is removed directly by the air.

By attaching the plate of the low dielectric to the vicinity of the lower portion of the resin rod electrode 8, it is possible to reduce the amount of powder adhered. Therefore, it becomes easy to remove the powder by the air blow.

The distance between the air pipe and the upper side electrode 2 may be determined in accordance with an area of a region which needs to be blown by the air.

Embodiment 4

Figure 10:
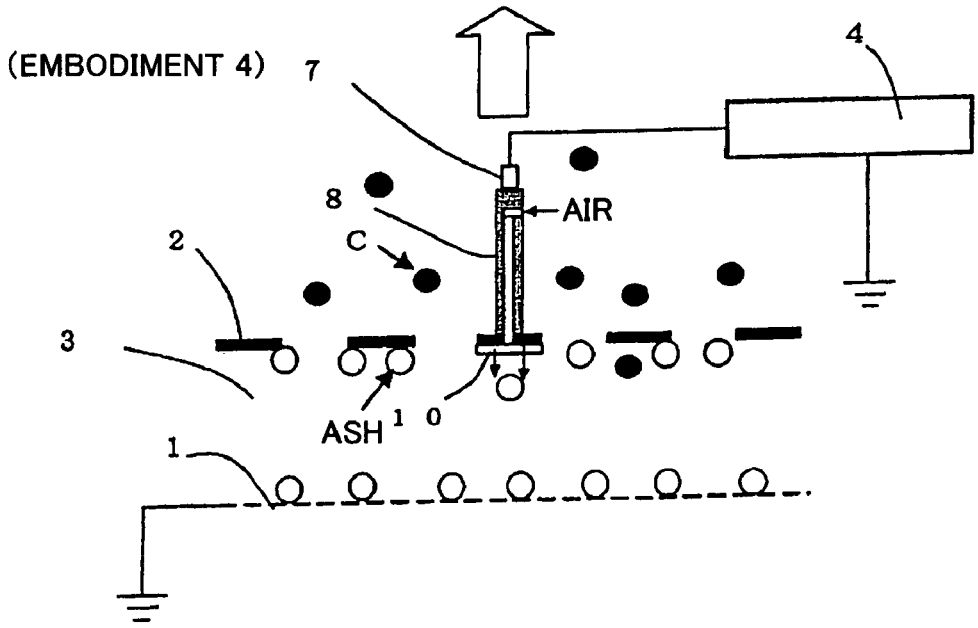
FIG. 10 is a diagram showing Embodiment 4 which uses the resin rod electrode, the air pipe and the low dielectric in the electrostatic separation device of the present invention.

FIG. 10 is a diagram showing Embodiment 4 which uses means for removing the adhered powder by the resin rod electrode and the air pipe, and the low dielectric in the electrostatic separation device of the present invention.

Air is supplied inside the resin rod electrode 8 corresponding to the high dielectric resin element of the present invention, and a porous plate is attached to the vicinity of the lower portion, so that the powder is removed.

By supplying the air inside the resin rod electrode 8, and attaching the porous plate 10 to the vicinity of the lower portion to remove the powder, it becomes unnecessary to provide the air pipe extended from outside, and it is possible to easily remove the powder. Instead of supplying the air inside the resin rod electrode, the air may be directly supplied to the porous plate using the air pipe.

The porous plate 10 may be determined for each experiment in light of the pressure loss and the clogging.

Embodiment 5

Figure 11:
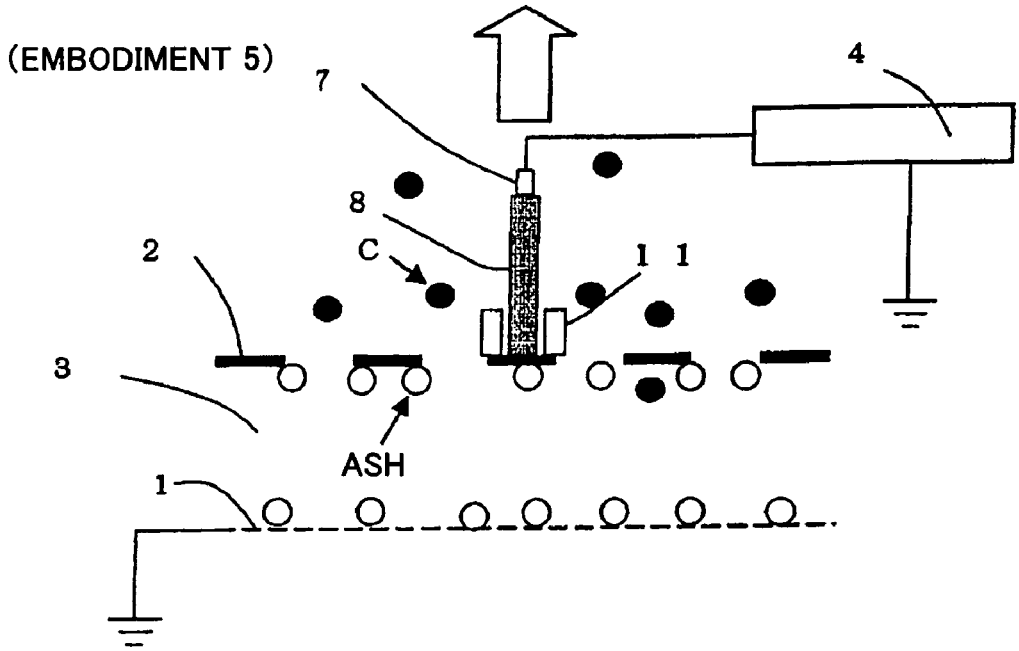
FIG. 11 is a diagram showing Embodiment 5 which uses the resin rod electrode, the air pipe and a ring-shaped weight in the electrostatic separation device of the present invention.

FIG. 11 is a diagram showing Embodiment 5 which uses means for removing the adhered powder by the resin rod electrode and the air pipe, and a ring-shaped weight in the electrostatic separation device of the present invention.

A ring-shaped weight 11 is attached to the resin rod electrode 8 corresponding to the high dielectric resin element of the present invention, and in this state, the powder is removed.

By attaching the ring-shaped weight 11 to the resin rod electrode 8, the vibration of the entire device is transmitted to the ring-shaped weight 11, which vibrates, and the powder adhered to the vicinity of the lower portion of the resin rod electrode 8 can be removed by this vibration.

The inner diameter of the ring-shaped weight 11 may be made larger than the diameter of the resin rod electrode by 1 mm or more.

Moreover, the ring-shaped weight 11 is desirably 5 g to 300 g, and preferably 20 g to 100 g. The material of the ring-shaped weight 11 may be any material, such as rubber, resin, ceramic or metal. The shape of the weight is not limited to the ring, and may be a ball. Moreover, the weight may be disposed on the entire surface.

Embodiment 6

Figure 12:
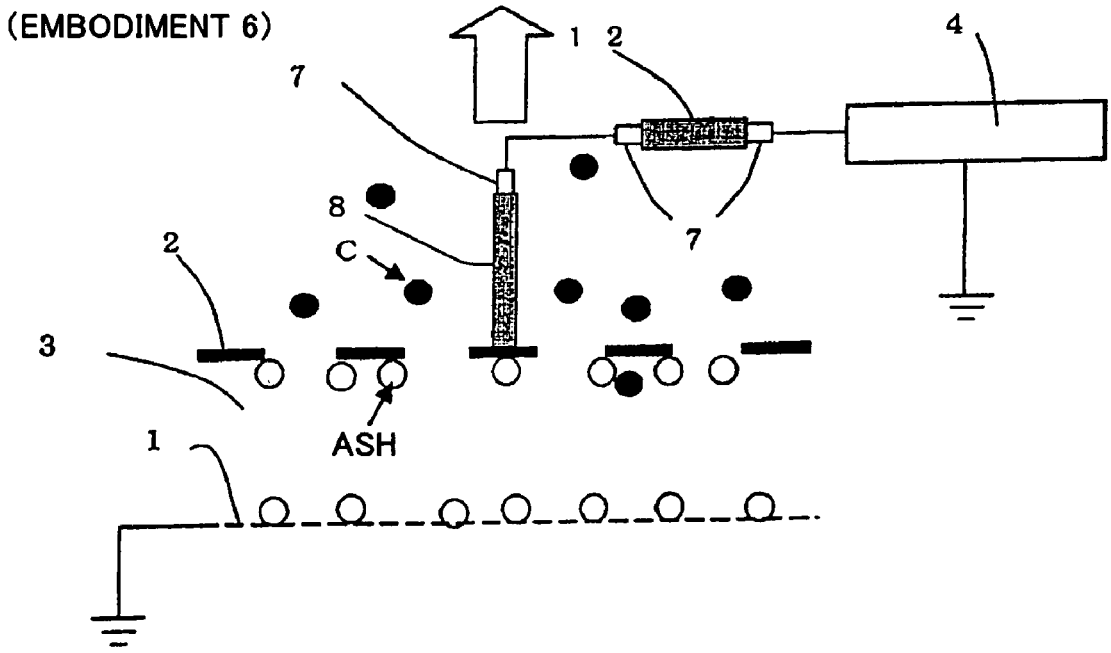
FIG. 12 is a diagram showing Embodiment 6 which uses the resin rod electrode and an intermediately inserted resin rod electrode in the electrostatic separation device of the present invention.

FIG. 12 is a diagram showing Embodiment 6 which uses the resin rod electrode and the intermediately inserted resin rod electrode in the electrostatic separation device of the present invention.

An intermediately inserted resin rod electrode 12 corresponding to the high dielectric resin element of the present invention is inserted into the intermediate point of the feeder line extending from the resin rod electrode 8 to the DC high voltage power source 4, and the following current countermeasure is carried out.

To be specific, the current flow is prevented by inserting the intermediately inserted resin rod electrode 12 into the intermediate point of the feeder line so that the positive and negative ions generated by the adherence of the powder cannot exchange the electrons with the power source side.

The diameter of the inserted resin rod electrode 12 is desirably Φ5 to Φ150, and preferably Φ20 to Φ40. The shape of the inserted resin rod electrode 12 is not limited to a round shape, and may be a square shape. The length of the inserted resin rod electrode 12 is desirably 2 mm to 500 mm, and preferably 50 mm to 100 mm.

Embodiment 7

Figure 13:
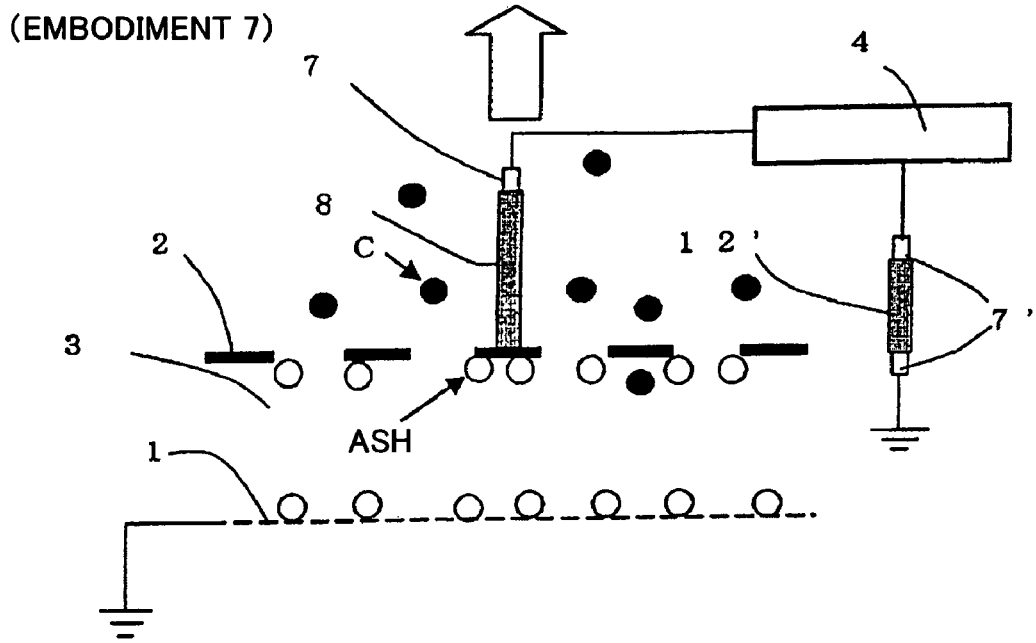
FIG. 13 is a diagram showing Embodiment 7 which uses the resin rod electrode and the intermediately inserted resin rod electrode in the electrostatic separation device of the present invention.

FIG. 13 is a diagram showing Embodiment 7 which uses the resin rod electrode and the intermediately inserted resin rod electrode in the electrostatic separation device of the present invention.

An intermediately inserted resin rod electrode 12' corresponding to the high dielectric resin element of the present invention is inserted into a ground wire of the DC high voltage power source 4, and the current countermeasure is carried out.

The current flow is prevented by inserting the intermediately inserted resin rod electrode 12' into the intermediate point of the feeder line so that the positive and negative ions generated by the adherence of the powder cannot exchange the electrons with the ground side.

Embodiment 8

Figure 14:
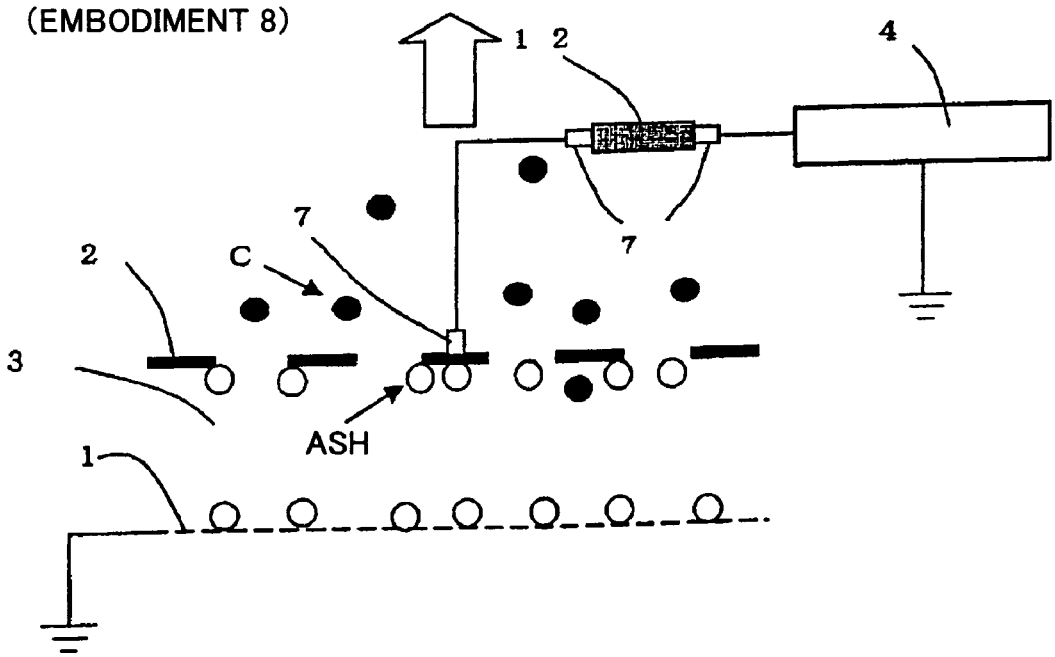
FIG. 14 is a diagram showing Embodiment 8 which uses the intermediately inserted resin rod electrode in the electrostatic separation device of the present invention.

FIG. 14 is a diagram showing Embodiment 8 which uses the intermediately inserted resin rod electrode in the electrostatic separation device of the present invention.

The intermediately inserted resin rod electrode 12 corresponding to the high dielectric resin element of the present invention is inserted into the intermediate point of the feeder line extending from the upper side electrode 2 to the DC high voltage power source 4, and the current countermeasure is carried out.

The current flow is prevented by inserting the intermediately inserted resin rod electrode 12 into the intermediate point of the feeder line so that the positive and negative ions generated by the adherence of the powder cannot exchange the electrons with the power source side.

Embodiment 9

Figure 15:
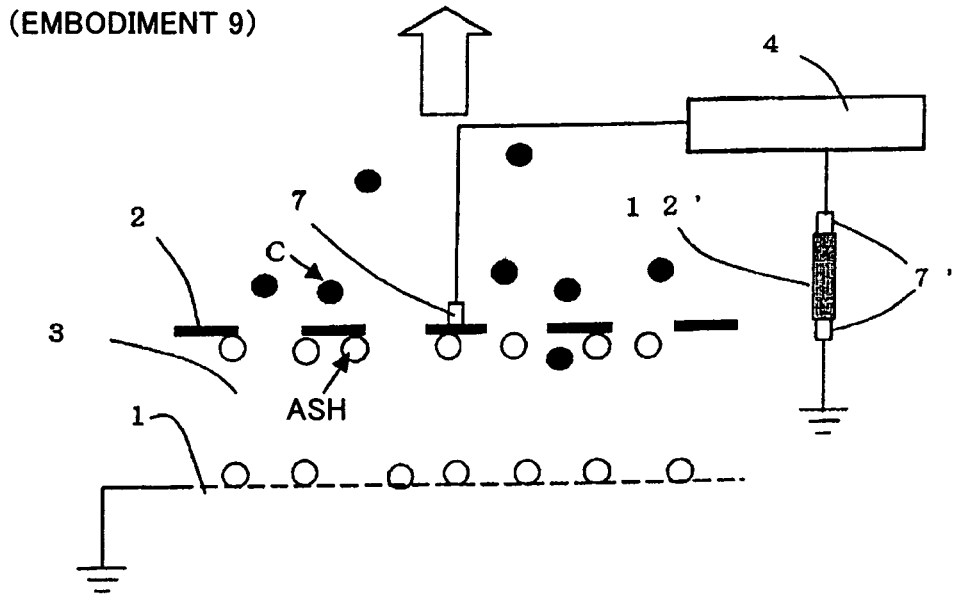
FIG. 15 is a diagram showing Embodiment 9 which uses the intermediately inserted resin rod electrode in the electrostatic separation device of the present invention.

FIG. 15 is a diagram showing Embodiment 9 which uses the intermediately inserted resin rod electrode in the electrostatic separation device of the present invention.

The intermediately inserted resin rod electrode 12' corresponding to the high dielectric resin element of the present invention is inserted into the ground wire of the DC high voltage power source 4, and the current countermeasure is carried out.

The current flow is prevented by inserting the intermediately inserted resin rod electrode 12' into the intermediate point of the feeder line so that the positive and negative ions generated by the adherence of the powder cannot exchange the electrons with the ground side.

As the materials of the resin mesh electrode, the resin rod electrode and the resin plate electrode, any high dielectric resin, such as phenol resin or vinyl chloride resin, can be used.

EXAMPLES

The electrostatic separation method and the electrostatic separation device of the present invention were used under the following conditions.

Example 1

Figure 16:
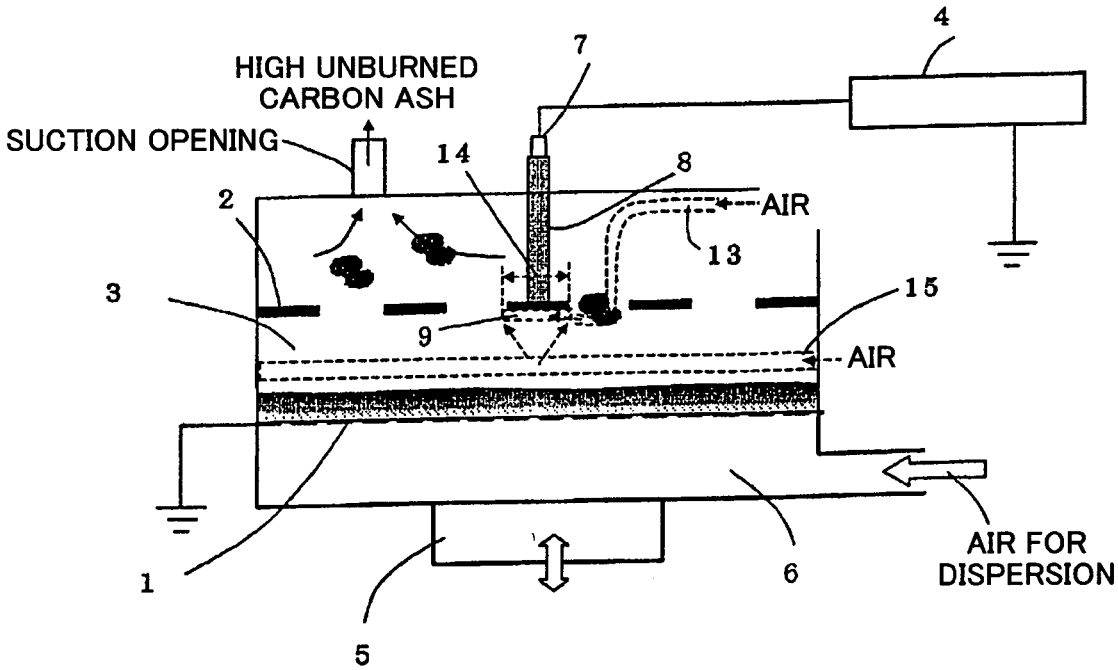
FIG. 16 is a diagram showing Examples of the electrostatic separation device of the present invention which carries out batch processing.

An experiment was carried out in accordance with the following basic configuration and conditions using the electrostatic separation device which carries out batch processing shown in FIG. 16.

1) Two-layer structure of upper side electrode

Mesh electrode 2 (resin mesh electrode) having a width of 100, a length of 200, and a thickness of 3

Resin rod electrode 8 having a diameter of 20 and a length of 100

2) Gap between the upper and lower electrodes: 80 mm (vertical distance between the lower side electrode 1 and the upper side electrode 2)

3) Raw powder: Coal ash (100 g) having the unburned carbon concentration of 25%

4) Current countermeasure: Air blow by guiding air using the air pipe 13 from the upper portion of the upper side electrode to the center of the lower surface of the upper side electrode 5) Area of a region where the adhered powder is removed: Range 14 that is a 50 mm square in the vicinity of the lower portion of the resin rod electrode 6) Linear velocity of blown air: 10 m/s 7) 5) Conditions of the vibration of the vibrator 5: Amplitude of 2 mm, Frequency of 28 Hz 8) 6) Amount of air supplied for dispersion: 16 L/min The high unburned carbon ash was collected from a suction opening under the above conditions. As a result, the current value was about 10 μA. Moreover, as a result of the ash separation, the concentration of the carbon of the high unburned carbon ash was 68% (28 g), and the concentration of the carbon of the low unburned carbon ash was 8% (72 g).

Example 2

An experiment was carried out in accordance with the following basic configuration and conditions using the electrostatic separation device which carries out the batch processing shown in FIG. 16.

9) Two-layer structure of upper side electrode

Mesh electrode 2 (resin mesh electrode) having a width of 100, a length of 200 and a thickness of 3

Resin rod electrode 8 having a diameter of 20 and a length of 100

10) Gap between the upper and lower electrodes: 80 mm (vertical distance between the lower side electrode 1 and the upper side electrode 2)

11) Raw powder: Coal ash (100 g) having the unburned carbon concentration of 27%

12) Current countermeasure: Effects of Countermeasures 1 and 2 below were confirmed.

13) Countermeasure 1: Air blow by guiding air using the air pipe 13 from the upper portion of the upper electrode to the center of the lower surface of the upper side electrode, and the plate (50 mm square) of the low dielectric 9

14) Countermeasure 2: Air blow by guiding air using the air pipe 15 from the lower portion of the upper electrode to the center of the lower surface of the upper side electrode, and the plate (50 mm square) of the low dielectric 9

15) Area of a region where the adhered powder is removed: Range 14 that is a 50 mm square in the vicinity of the lower portion of the resin rod electrode 16) Linear velocity of blown air: 10 m/s 17)5) Conditions of the vibration of the vibrator 5: Amplitude of 2 mm, Frequency of 28 Hz 18)6) Amount of air supplied for dispersion: 16 L/min The high unburned carbon ash was collected from the suction opening under the above conditions. As a result, the experimental result of Countermeasure 1 and the experimental result of Countermeasure 2 were substantially the same as each other, and the current value was further low, that is, about 4 μA. As a result of the ash separation, the concentration of the carbon of the high unburned carbon ash was 70% (32 g), and the concentration of the carbon of the low unburned carbon ash was 7% (68 g).

Example 3

An experiment was carried out in accordance with the following basic configuration and conditions using the electrostatic separation device which carries out the batch processing shown in FIG. 16.

19) Two-layer structure of upper side electrode

Mesh electrode 2 (resin mesh electrode) having a width of 100, a length of 200 and a thickness of 3

Resin rod electrode 8 having a diameter of 20 and a length of 100

20) Gap between the upper and lower electrodes: 80 mm (vertical distance between the lower side electrode 1 and the upper side electrode 2)

21) Raw powder: Coal ash (100 g) having the unburned carbon concentration of 21%

22) Current countermeasure: Air supply by causing air to pass through the inside of the resin rod electrode, and the area of the porous plate (50 mm square)

23) (The configuration of the resin rod electrode 8 is the same as the configuration shown in FIG. 10.)

24) Area of a region where the adhered powder is removed: Range 14 that is a 50 mm square in the vicinity of the lower portion of the resin rod electrode 25) Linear velocity of blown air: 5 m/s 26)5) Conditions of the vibration of the vibrator 5: Amplitude of 2 mm, Frequency of 28 Hz 27)6) Amount of air supplied for dispersion: 16 L/min The high unburned carbon ash was collected from the suction opening under the above conditions. As a result, the current value was further low, that is, about 2 μA. As a result of the ash separation, the concentration of the carbon of the high unburned carbon ash was 65% (25 g), and the concentration of the carbon of the low unburned carbon ash was 6% (75 g).

Example 4

Figure 17:
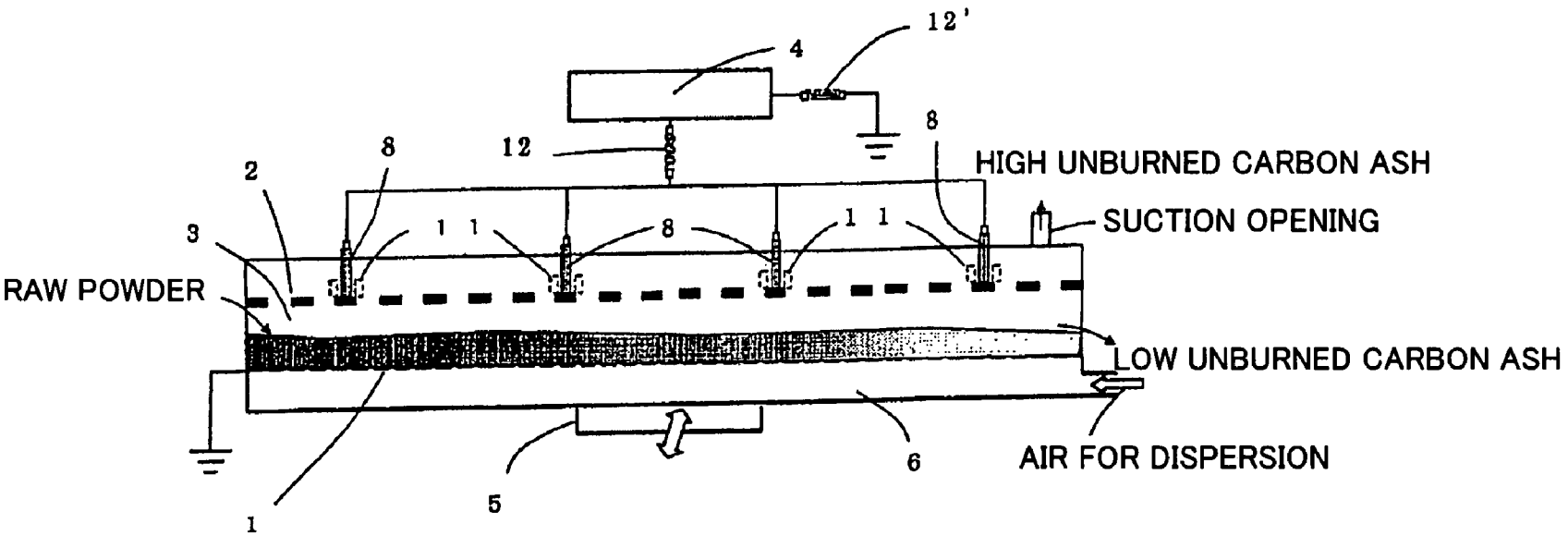
FIG. 17 is a diagram showing Examples of the electrostatic separation device of the present invention which carries out continuous processing in the case of including a resin rod electrode 8.

An experiment was carried out in accordance with the following basic configuration and conditions using the electrostatic separation device which carries out the continuous processing shown in FIG. 17.

28) Two-layer structure of upper side electrode

Mesh electrode 2 (resin mesh electrode) having a width of 200, a length of 1,600 and a thickness of 3

Four Resin rod electrodes 8 each having a diameter of 20 and a length of 100

29) Gap between the upper and lower electrodes: 80 mm (vertical distance between the lower side electrode 1 and the upper side electrode 2)

30) Raw powder: Coal ash having the unburned carbon concentration of 24%

31) Amount of continuous supply: 100 kg/h

32) Current countermeasure: Attaching of four ring-shaped weights 11 to the respective resin rod electrodes 33) Spec of each ring: Inner diameter of 22 mm, Weight of 75 g 34)5) Conditions of the vibration of the vibrator 5: Amplitude of 2 mm, Frequency of 28 Hz 35)6) Amount of air supplied for dispersion: 260 L/min 36) The unburned carbon ash was collected from the suction opening under the above conditions. As a result, the total current value of four resin rod electrodes was about 20 μA. As a result of the ash separation, the concentration of the carbon of the high unburned carbon ash was 67% (26 kg/h), and the concentration of the carbon of the low unburned carbon ash was 9% (74 kg/h).

Example 5

An experiment was carried out in accordance with the following basic configuration and conditions using the electrostatic separation device which carries out the continuous processing shown in FIG. 17.

37) Two-layer structure of upper side electrode

Mesh electrode 2 (resin mesh electrode) having a width of 200, a length of 1,600 and a thickness of 3

Four resin rod electrodes 8 each having a diameter of 20 and a length of 100

38) Gap between the upper and lower electrodes: 80 mm (vertical distance between the lower side electrode 1 and the upper side electrode 2)

39) Raw powder: Coal ash having the unburned carbon concentration of 29%

40) Amount of continuous supply: 100 kg/h

41) Current countermeasure: Effects of Countermeasures 1 and 2 below were confirmed.

42) Countermeasure 1: Insertion of the resin rod electrode 12 in a supply line extending from the resin rod electrode to the DC high voltage power source 43) Countermeasure 2: Insertion of the resin rod electrode 12' in the ground wire of the DC high voltage power source 1. Spec of the inserted resin rod electrode: Diameter of 20, Length of 60

44)5) Conditions of the vibration of the vibrator 5: Amplitude of 2 mm, Frequency of 28 Hz 45)6) Amount of air supplied for dispersion: 260 L/min 46) The high unburned carbon ash was collected from the suction opening under the above conditions. As a result, the experimental result of the of Countermeasure 1 and the experimental result of the of Countermeasure 2 were substantially the same as each other, and the total current value of four resin rod electrodes was about 2 μA. As a result of the ash separation, the concentration of the carbon of the high unburned carbon ash was 69% (33 kg/h), and the concentration of the carbon of the low unburned carbon ash was 9% (67 kg/h).

Example 6

Figure 18:
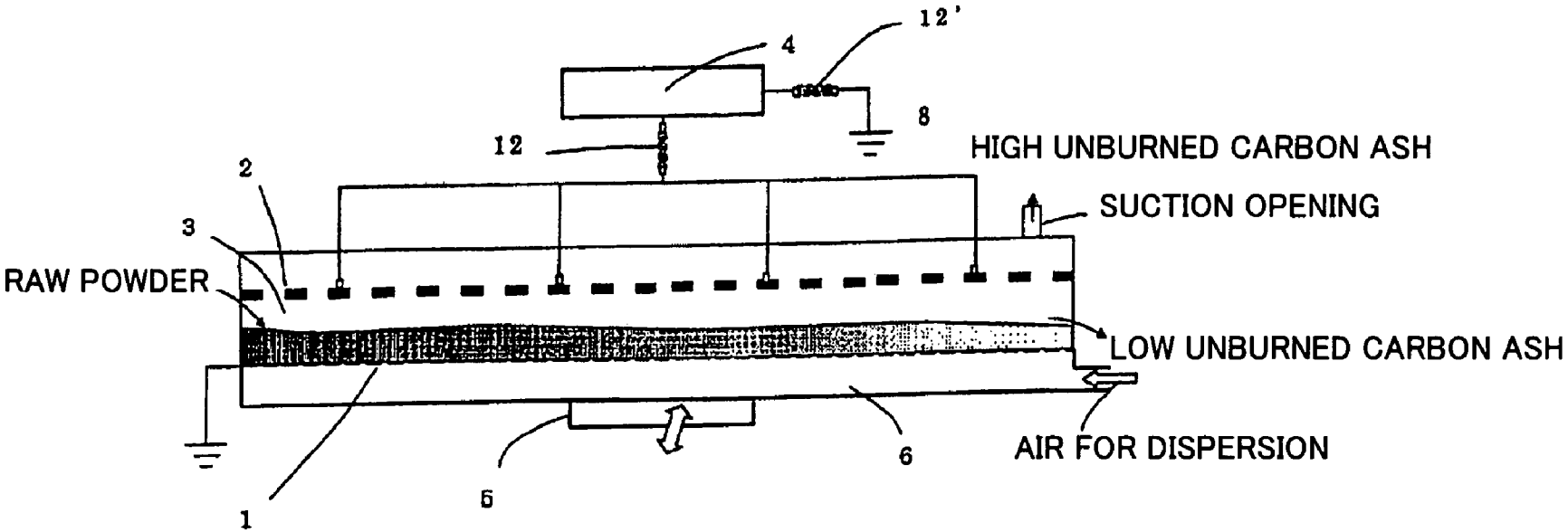
FIG. 18 is a diagram showing Examples of the electrostatic separation device of the present invention which carries out the continuous processing in the case of not including the resin rod electrode 8.

An experiment was carried out in accordance with the following basic configuration and conditions using the electrostatic separation device which carries out the continuous processing shown in FIG. 18.

47) Two-layer structure of upper side electrode

48) Mesh electrode 2 (metal mesh electrode) having a width of 200, a length of 1,600 and a wire diameter of 1

49) Gap between the upper and lower electrodes: 80 mm (vertical distance between the lower side electrode 1 and the upper side electrode 2)

50) Raw powder: Coal ash having the unburned carbon concentration of 24%

51) Amount of continuous supply: 100 kg/h 52)4) Current countermeasure: Insertion of the resin rod electrode 12 in the supply line extending from the resin rod electrode to the DC high voltage power source 53) Spec of the inserted resin rod electrode: Diameter of 20, Length of 60

54)5) Conditions of the vibration of the vibrator 5: Amplitude of 2 mm, Frequency of 28 Hz 55)6) Amount of air supplied for dispersion: 260 L/min 56) The high unburned carbon ash was collected from the suction opening under the above conditions. As a result, a spike-shaped current waveform became smooth, and the current value was about 30 μA. As a result of the ash separation, the concentration of the carbon of the high unburned carbon ash was 67% (26 kg/h), and the concentration of the carbon of the low unburned carbon ash was 9% (74 kg/h).

Example 7

An experiment was carried out in accordance with the following basic configuration and conditions using the electrostatic separation device which carries out the continuous processing shown in FIG. 18.

57) Two-layer structure of upper side electrode

58) Resin plate electrode having a width of 200, a length of 1,600 and a thickness of 3 (alternative to the mesh electrode 2)

59) Gap between the upper and lower electrodes: 80 mm (vertical distance between the lower side electrode 1 and the upper side electrode 2)

60) Raw powder: Coal ash having the unburned carbon concentration of 30%

61) Amount of continuous supply: 100 kg/h 62)4) Current countermeasure: Insertion of the resin rod electrode 12' in the ground wire of the DC high voltage power source 63) Spec of the inserted resin rod electrode: Diameter of 20, Length of 60

64)5) Conditions of the vibration of the vibrator 5: Amplitude of 2 mm, Frequency of 28 Hz 65)6) Amount of air supplied for dispersion: 260 L/min 66) The high unburned carbon ash was collected from the suction opening under the above conditions. As a result, the current value was about 25 μA. As a result of the ash separation, the concentration of the carbon of the high unburned carbon ash was 71% (35 kg/h), and the concentration of the carbon of the low unburned carbon ash was 8% (65 kg/h).

Thus, the above Examples confirmed that even in a case where the concentration of the unburned component in the coal ash produced by the boiler in the coal-fired power plant is as high as 15% to 30%, it is possible to stably separate the ash (into the high unburned component ash and the low unburned component ash) without generating the spark.

The invention claimed is:

1. An electrostatic separation device which separates unburned carbon ash contained in coal ash by an electrostatic force, comprising:

a lower side electrode; and an upper side electrode disposed above the lower side electrode with a predetermined distance therebetween;

wherein the upper side electrode comprises a resin rod electrode made of dielectric resin and a mesh electrode having a large number of openings which allow the coal ash to pass therethrough.

2. The electrostatic separation device according to claim 1, further comprising a remover for removing powder adhered to the upper side electrode by using air.

3. The electrostatic separation device according to claim 1, further comprising a remover for removing powder adhered to the upper side electrode using means for vibrating or impacting the upper electrode.

4. The electrostatic separation device according to claim 1, wherein the mesh electrode is made of metal.

5. The electrostatic separation device according to claim 1, wherein the mesh electrode is made of dielectric resin.

* * * * *